US006569271B2

(12) United States Patent
Cho

(10) Patent No.: US 6,569,271 B2
(45) Date of Patent: May 27, 2003

(54) ALUMINUM ALLOYS AND METHODS OF MAKING THE SAME

(75) Inventor: Alex Cho, Darien, IL (US)

(73) Assignee: Pechiney Rolled Products, LLC., Ravenswood, WV (US)

( * ) Notice: Subject to any disclaimer, the term of this patent is extended or adjusted under 35 U.S.C. 154(b) by 0 days.

(21) Appl. No.: 09/795,280

(22) Filed: Feb. 28, 2001

(65) Prior Publication Data

US 2002/0157742 A1 Oct. 31, 2002

(51) Int. Cl.[7] ..... C22F 1/053
(52) U.S. Cl. ..... 148/701
(58) Field of Search ..... 148/690, 693, 148/694, 697, 701, 698

(56) References Cited

U.S. PATENT DOCUMENTS

| | | | | |
|---|---|---|---|---|
| 4,431,467 A | | 2/1984 | Staley et al. | 148/159 |
| 4,477,292 A | | 10/1984 | Brown | 148/20 |
| 4,832,758 A | | 5/1989 | Brown | 148/12.7 |
| 4,863,528 A | | 9/1989 | Brown et al. | 148/12.7 |
| 5,035,754 A | * | 7/1991 | Sakiyama et al. | 148/417 |
| 5,108,520 A | | 4/1992 | Liu et al. | 148/12.7 |
| 5,135,713 A | | 8/1992 | Rioja et al. | 420/532 |
| 5,221,377 A | | 6/1993 | Hunt, Jr. et al. | 148/217 |
| 5,312,498 A | * | 5/1994 | Anderson | 148/417 |
| 5,630,889 A | | 5/1997 | Karabin | 148/417 |
| 5,665,306 A | | 9/1997 | Karabin | 420/535 |
| 5,800,927 A | | 9/1998 | Karabin | 428/457 |
| 5,879,475 A | | 3/1999 | Karabin | 148/417 |
| 6,048,415 A | * | 4/2000 | Nakai et al. | 148/417 |

* cited by examiner

*Primary Examiner*—George Wyszomierski
*Assistant Examiner*—Janelle Combs-Morillo
(74) *Attorney, Agent, or Firm*—Jenkens & Gilchrist

(57) ABSTRACT

A process for thermally treating an article made from an aluminum alloy. The process comprises providing the aluminum alloy that consists essentially of from about 5.7 to about 6.7 wt. % of zinc, less than 2.2 wt. % copper, less than 4.2 wt. % of the total weight percent of magnesium and copper combined, and less than 10.60 wt. % of the total weight percent of magnesium, copper and zinc combined, the balance being substantially aluminum, incidental elements and impurities. The article is artificially aged at a first temperature. The article is heated to a second temperature, wherein the second temperature is higher than the first temperature. The article is artificially aged at the second temperature of from about 290 to about 360° F. for a duration of at least 6 hours. The article is cooled from the second temperature to 200° F. at a cooling rate of from about 20 to about 40° F./hour.

31 Claims, 8 Drawing Sheets

(Short Transverse Direction)

(Longitudinal Direction)

(Long Transverse Direction)

(Short Transverse Direction)

(Longitudinal Direction)

(Long Transverse Direction)

ALUMINUM ALLOYS AND METHODS OF MAKING THE SAME

FIELD OF THE INVENTION

The present invention relates generally to zinc and magnesium-bearing aluminum alloys and processes for making the same. More specifically, the present invention is related to age-hardenable, high strength, high fracture toughness and high corrosion resistant aluminum alloys and processes of making the same.

BACKGROUND OF THE INVENTION

Aluminum alloys have been used in the past in forming a variety of articles or products for structural applications. Some of those aluminum alloys are used in, for example, the aerospace industry. Designers and manufacturers in the aerospace industry are constantly trying to improve fuel efficiency and product performance. One method for improving such items is to produce lightweight materials with improved fracture toughness and corrosion resistance performance without losing relative strength.

The strengthening of age-hardenable aluminum alloys has traditionally involved solid solution heat treating, quenching, and natural or artificial aging. Natural aging generally consists of allowing the solution heat treated aluminum alloy articles to remain at about room temperature for a significant period of time. It is, however, commercially more feasible to artificially age these articles for shorter times at higher temperatures than room temperature. The strengthening of some aluminum alloys may include cold work, such as compression or stretching of the article: Cold work is typically performed on the age-hardenable aluminum alloy article before it is aged.

Accordingly, a need exists for a high strength, high fracture toughness and high corrosion resistant aluminum alloy and processes for making the same.

SUMMARY OF THE INVENTION

According to one process, an aluminum alloy is thermally treated. The aluminum alloy consists essentially of from about 5.7 to about 6.7 wt. % of zinc, less than 2.2 wt. % copper, less than 4.2 wt. % of the total weight percent of magnesium and copper combined, and less than 10.60 wt. % of the total weight percent of magnesium, copper and zinc combined, the balance being substantially aluminum, incidental elements and impurities. The article is solid solution heat treated and then quenched. The article is heated to a first temperature and artificially aged at the first temperature. The article is heated to a second temperature, wherein the second temperature is higher than the first temperature. The article is artificially aged at the second temperature of from about 290 to about 360° F. for a duration of at least 6 hours. The article is cooled from the second temperature to 200° F. at a cooling rate of from about 20 to about 40° F./hour.

According to another process, an aluminum alloy is thermally treated. The aluminum alloy consists essentially of from about 5.7 to about 6.7 wt. % of zinc, less than 2.2 wt. % copper, less than 4.2 wt. % of the total weight percent of magnesium and copper combined, and less than 10.60 wt. % of the total weight percent of magnesium, copper and zinc combined, the balance being substantially aluminum, incidental elements and impurities. The article is artificially aged at a first temperature. The article is heated to a second temperature, wherein the second temperature is higher than the first temperature. The article is artificially aged at the second temperature of from about 290 to about 360° F. for a duration of at least 6 hours. The article is cooled from the second temperature to 200° F. at a cooling rate of from about 20 to about 40° F./hour.

According to yet another process, an aluminum alloy is thermally treated. The aluminum alloy consists essentially of from about 5.7 to about 6.7 wt. % of zinc, less than 2.2 wt. % copper, less than 4.2 wt. % of the total weight percent of magnesium and copper combined, and less than 10.60 wt. % of the total weight percent of magnesium, copper and zinc combined, the balance being substantially aluminum, incidental elements and impurities. The article is artificially aged at a first temperature. The article is heated to a second temperature, wherein the second temperature is higher than the first temperature. The heat up rate from the first temperature to the second temperature is from about 25 to about 40° F./hour. The article is artificially aged at the second temperature of from about 290 to about 360° F. for a duration of at least 6 hours. The article is cooled from the second temperature to 200° F. at a cooling rate of from about 20 to about 40° F./hour.

BRIEF DESCRIPTION OF THE DRAWINGS

Other objects and advantages of the invention will become apparent upon reading the following detailed description and upon reference to the drawings in which.

DETAILED DESCRIPTION OF THE ILLUSTRATIVE EMBODIMENTS

Figure 1:
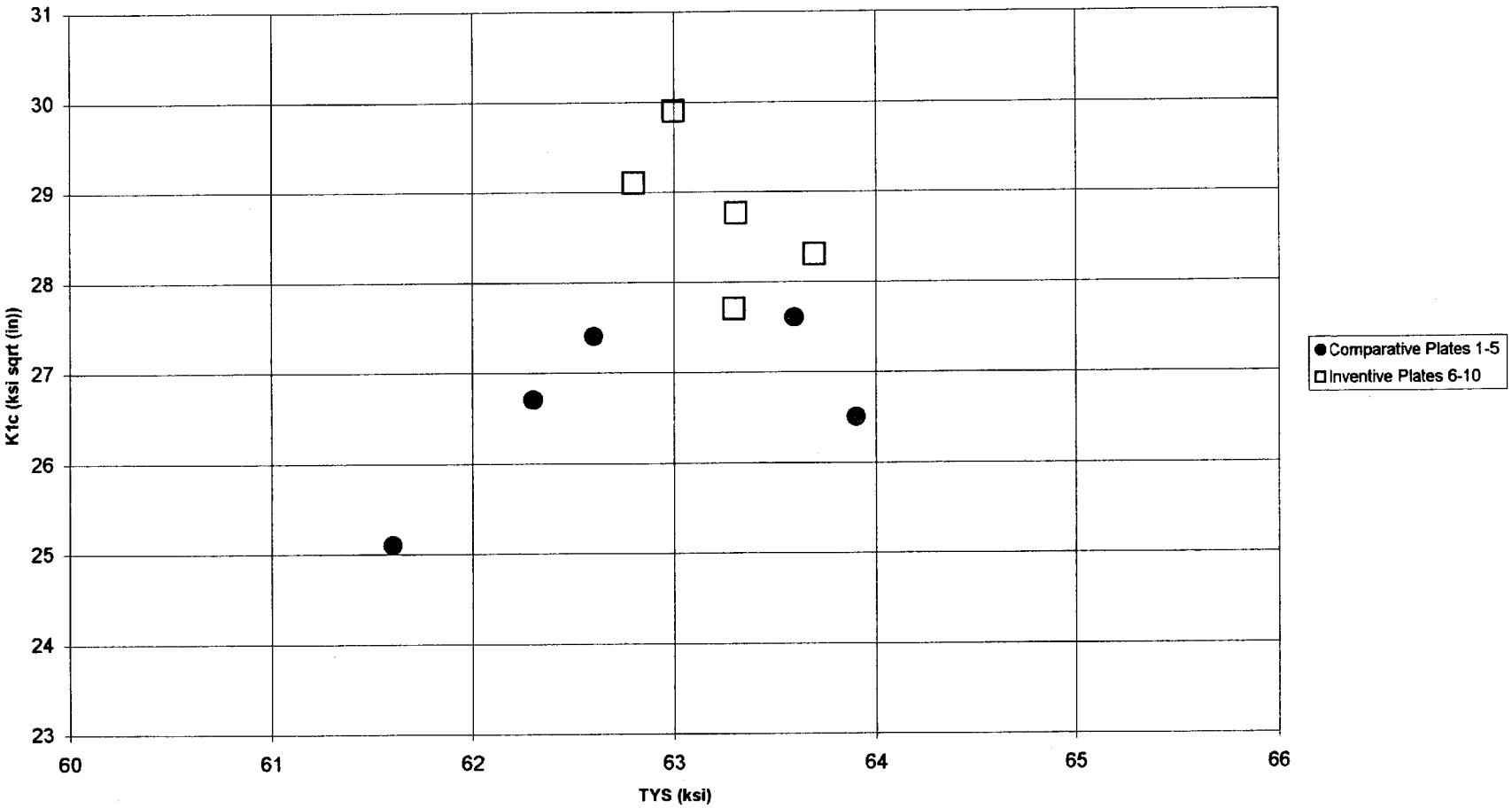
FIG. 1 is a graph depicting the plane strain fracture toughness and the tensile yield strength of a group of inventive plates and a group of comparative plates in the short transverse direction.

The aluminum alloy articles or products of the present invention have high strengths, high fracture toughness and high corrosion resistance. The aluminum alloys of the present invention include Al—Zn—Mg—Cu (Aluminum- Zinc-Magnesium-Copper) based alloys, Al—Zn—Cu—Mg (Aluminum-Zinc-Copper-Magnesium) based alloys, Al—Zn—Mg—Cu—Zr (Aluminum-Zinc-Magnesium-Copper-Zirconium) based alloys and Al—Zn—Cu—Mg—Zr (Aluminum-Zinc-Copper-Magnesium-Zirconium) based alloys.

Zinc and magnesium are desirable because they form $MgZn_2$ particles that are very effective strengthening particles. Copper is desirable because it assists in increasing strength without losing fracture toughness significantly by assisting precipitation of various strengthening precipitates. Zirconium is desirable because it controls grain structure by preventing recrystallization process taking place during solution heat treatment. Other contemplated aluminum alloys of the present invention include Al—Zn—Mg—Cu—X or Al—Zn—Cu—Mg—X, where X may be selected from materials such as silver, manganese, silicon and lithium, and grain refiners such as zirconium, chromium, vanadium, indium, scandium, iron, hafnium, yttrium, lanthanides and combinations thereof.

The aluminum alloy articles or products of the present invention comprise various compositions. The aluminum alloys comprise from about 5.7 to about 6.7 wt. % zinc, less than 2.2 wt. % copper, less than 4.2 wt. % of the total weight percent of magnesium and copper combined, and less than 10.60 wt. % of the total weight percent of zinc, magnesium and copper combined, with the remainder being substantially aluminum, incidental elements and impurities. More specifically, the aluminum alloys comprise from about 5.7 to about 6.7 wt. % zinc, from about 1.9 to about 2.1 wt. % magnesium, from about 2.0 wt. % to 2.2 wt. % copper, with the balance being substantially aluminum, incidental elements and impurities.

The aluminum alloy generally comprises from 0 to about 0.20 wt. % and, more specifically, from about 0.08 to about 0.12 wt. % zirconium. The aluminum alloy generally comprises from 0 to about 0.8 wt. % and, more specifically, from 0 to 0.6 wt. % of silver, scandium, chromium and/or manganese.

The aluminum alloy articles formed by the present invention have high strengths as measured by ultimate tensile strength (UTS) and tensile yield strength (TYS). Ultimate tensile strength and tensile yield strength are determined by ASTM B557.

The ultimate tensile strength of an aluminum alloy sample of the present invention at room temperature in the short transverse direction is generally greater than about 60 kilopounds per square inch (ksi), preferably greater than about 65 ksi and most preferably greater than about 70 ksi as determined by ASTM B557. The ultimate tensile strength of an aluminum alloy sample of the present invention at room temperature in the longitudinal direction is generally greater than about 60 ksi, preferably greater than about 65 ksi and most preferably greater than about 70 ksi as determined by ASTM B557. The ultimate tensile strength of an aluminum alloy sample of the present invention at room temperature in the long transverse direction is generally greater than about 60 ksi, preferably greater than about 65 ksi and most preferably greater than about 70 ksi as determined by ASTM B557.

The tensile yield strength of an aluminum alloy sample of the present invention at room temperature of the short transverse direction is generally greater than about 50 ksi, preferably greater than about 55 ksi and most preferably greater than about 60 ksi as determined by ASTM B557. The tensile yield strength of an aluminum alloy sample of the present invention at room temperature of the longitudinal direction is generally greater than about 55 ksi, preferably greater than about 60 ksi and most preferably greater than about 65 ksi as determined by ASTM B557. The tensile yield strength of an aluminum alloy sample of the present invention at room temperature of the long transverse direction is generally greater than about 55 ksi, preferably greater than about 60 ksi and most preferably greater than about 65 ksi as determined by ASTM B557.

The plane strain fracture toughness of an aluminum alloy sample of the present invention at room temperature in the short transverse direction of greater than about 20 ksi sqrt(inch) and more specifically greater than about 25 ksi sqrt(inch) as determined by ASTM B645. The plane strain fracture toughness of an aluminum alloy sample of the present invention at room temperature in the longitudinal direction of greater than about 25 ksi sqrt(inch) and more specifically greater than about 30 ksi sqrt(inch) as determined by ASTM B645. The plane strain fracture toughness of an aluminum alloy sample of the present invention at room temperature in the long transverse direction of greater than about 20 ksi sqrt(inch) and more specifically greater than about 25 ksi sqrt(inch) as determined by ASTM B645.

The stress corrosion factor of an aluminum alloy article of the present invention at room temperature as determined by AMS-4050 is preferably less than about 32 and more preferably less than about 28 as determined by AMS-4050. The stress corrosion factor of an aluminum alloy of the present invention is preferably less than about 27.

The aluminum alloys may be used in the aerospace industry on articles such as wings, bulkhead and spars.

Solid solution heat treatment is traditionally performed on age-hardenable wrought aluminum alloy articles or products. The wrought article is formed from a hot deformation or fabrication process to its desired shape. The solid solution heat treatment embeds the aluminum alloy components in a generally uniform manner throughout the aluminum alloy article.

The aluminum alloy article containing zinc, magnesium, copper and other elements is solution heat treated at temperatures generally from about 850 to about 950° F. The solid solution heat treatment of the aluminum alloys articles occurs at these temperatures for durations generally from a few minutes to about 8 hours depending on the thickness of the article and, more typically, from about 30 minutes to about 4 hours. The solid solution heat treating of the aluminum alloy articles should be of a sufficient duration to allow substantially all soluble alloy components to enter into the solid solution.

After solid solution heat treating, fast cooling or quenching is performed on the aluminum alloy article. Fast cooling or quenching may be performed by various processes known in the art. Examples of quenching include water quenching, oil quenching, other liquid quenching or quenching by fast moving forced air. The quenching should occur quickly so as to maintain the super saturated solid solution from the solid solution heat treatment. The quenching of the aluminum alloy articles reduces the temperature from that in the solid solution heat treatment to generally room temperature (about 70° F.). The quenching is generally performed within about 10 seconds after the article is removed from the heat treat furnace.

As discussed above, cold work may be performed on the aluminum alloy articles of the present invention. Cold work is generally defined as the introduction of plastic deformation at or near room temperature. Various known cold working practices include stretching, cold rolling and cold forging, such as compression. Cold work is typically performed at or near room temperature. Cold work can stretch or compress some aluminum alloy articles from about 1 to about 10% and typically stretches or compresses those articles from about 2 to about 4%. Cold work is often performed on flat articles or products to reduce residual stress and, for some aluminum alloys, to increase strength after artificial aging. Cold work may not be performed on certain aluminum alloy articles, such as those with complicated shape forging or formed parts.

After quenching or performing optional cold work, the age-hardenable aluminum alloy article is subjected to artificial aging. According to one artificial aging process of the present invention, the alloys discussed above (e.g., Al—Zn—Mg—Cu, Al—Zn—Cu—Mg, Al—Zn—Mg—Cu—Zr and Al—Zn—Cu—Mg—Zr) are artificially aged using two steps.

The first artificial aging step of the present invention includes soaking the aluminum alloy article at a temperature generally from about 220 to about 280° F. and for at least about 30 minutes and more typically from about 4 to about 16 hours depending on the temperature. The soaking may occur in air, hot oil, salt bath, or molten metal as long as the medium does not damage the aluminum alloy. More specifically, the first artificial aging step of the present invention includes soaking the aluminum alloy at a temperature from about 240 to about 260° F. for a time of generally from about 6 to about 10 hours. Optimal times typically vary depending upon alloy composition and age temperature.

The aluminum alloy may be heated to a higher second step artificial aging temperature at a heat up rate from about 5 to about 40° F./hour. More specifically, the heat-up rate is from about 25 to about 40° F./hour or from about 25 to about 30° F./hour.

The second artificial aging step of the present invention includes soaking the aluminum alloy at a temperature generally from about 290 to about 360° F. for a time of at least 6 hours and more typically from about 18 to about 30 hours. More specifically, the second artificial aging step of the present invention includes soaking the aluminum alloy at a temperature from about 310 to about 330° F. for a time from about 22 to about 28 hours.

After the second artificial aging step, the aluminum alloy is cooled to room temperature with a controlled cooling rate from the temperature of the second artificial aging step to 200° F. The cooling rate from the temperature of the second artificial aging step to 200° F. is from about 20 to about 40° F./hr. More specifically, this controlled cooling rate is from about from about 20 to about 30° F./hr, or from about 25 to about 30° F./hr.

To achieve the desired properties of the aluminum alloy article, the cooling rate should be within these ranges. The cooling rate to room temperature from 180° F., however, may be outside of these ranges since it is less important for producing a desirable wrought aluminum alloy.

The second artificial aging step of the present invention may take place directly after the first artificial aging step (i.e., when the aluminum alloy article is still warm). Alternatively, the second artificial aging step may take place after the aluminum alloy article has been cooled to a temperature, such as room temperature. If the aluminum alloy article is cooled, it needs to be heated to the temperature of the second artificial aging step of the present invention.

EXAMPLES

To better assist in showing the desirable properties of the aluminum alloys of the present invention, Comparative Examples 1–5 and Inventive Examples 6–10 were performed. Inventive Plates 6–10 had lower amounts of both copper and magnesium than the Comparative Plates 1–5. Comparative Plates 1–5 had a copper and magnesium combined total wt. % over 4.20, and a total wt. % of zinc, copper and magnesium combined over 10.60. Inventive Plates 6–10 and Comparative Plates 1–5 also were formed by different process steps wherein Inventive Plates 6–10 were formed using a much higher cooling rate (25–30° F./hour) than Comparative Plates 1–5 (5–15° F./hour). Comparative Plates 1–5 used a conventional process (T7451) and a typical aluminum alloy composition (7050), while Inventive Plates 6–10 used an inventive process and an inventive aluminum alloy composition.

The details of the compositions and processing conditions of Comparative Examples 1–5 and Inventive Examples 6–10 are described below.

Comparative Examples 1–5

Comparative Example 1

A large commercially produced ingot was cast with an alloy composition listed in Table 1. The ingot was homogenized at 890° F. for 24 hours and then air cooled to room temperature. The ingot was scalped to about 1" from each surface and then hot rolled to a 5" thickness plate at a temperature range of 830° F. to 700° F. The 5" plate was solution heat treated at about 870 to 890° F. in an air furnace for about 2 to 4 hours then water quenched to room temperature.

After water quenching, the plate was artificially aged in two steps. The first artificial aging step was performed at 250° F. for 8 hours, while the second artificial aging step was performed at 320° F. for 24 hours on the aluminum alloy article. The heating rate of the temperature from the first artificial aging step to the second artificial step was 10–20° F./hour. After the artificial aging step, the plate was cooled to 200° F. from 320° F. at a cooling rate of from 5–15° F./hour.

The plate was tested for various mechanical properties such as ultimate tensile strength (UTS), tensile yield stress (TYS) and plane strain fracture toughness (K1c). The testing results from these mechanical properties are listed in Table 2. The stress corrosion factor (SCF) of the plate was also tested and the result is shown in Table 2.

Comparative Examples 2–5

The plates of Comparative Examples 2–5 were formed in the same manner as the plate of Comparative Example 1, except that the compositions of the plates were not the same. The compositions and testing results of the plates of Comparative Examples 2–5 are listed in Tables 1 and 2, respectively.

TABLE 1

| | Comparative Example Plate Nos. | | | | |
|---|---|---|---|---|---|
| Composition | 1 | 2 | 3 | 4 | 5 |
| Si (wt. %) | 0.04 | 0.04 | 0.04 | 0.04 | 0.03 |
| Fe (wt. %) | 0.07 | 0.08 | 0.07 | 0.07 | 0.08 |

TABLE 1-continued

| Composition | Comparative Example Plate Nos. 1 | 2 | 3 | 4 | 5 |
|---|---|---|---|---|---|
| Cu (wt. %) | 2.26 | 2.22 | 2.23 | 2.24 | 2.18 |
| Mg (wt. %) | 2.18 | 2.2 | 2.2 | 2.2 | 2.26 |
| Zn (wt. %) | 6.44 | 6.41 | 6.36 | 2.46 | 6.38 |
| Zr (wt. %) | 0.11 | 0.11 | 0.11 | 0.10 | 0.10 |
| Cu + Mg (wt. %) | 4.44 | 4.42 | 4.43 | 4.44 | 4.44 |
| Cu + Mg + Zn (wt. %) | 10.88 | 10.83 | 10.79 | 10.90 | 10.82 |

TABLE 2

| Test | Test Direction | Comparative Example Plate Nos. 1 | 2 | 3 | 4 | 5 |
|---|---|---|---|---|---|---|
| UTS[1] (ksi) | ST[5] | 74 | 73.3 | 74.4 | 73.9 | 73.1 |
| TYS[2] (ksi) | ST | 63.6 | 61.6 | 63.9 | 62.3 | 62.6 |
| K1c[3] ksi sqrt (inch) | S-L | 27.6 | 25.1 | 26.5 | 26.7 | 27.4 |
| UTS (ksi) | L[6] | 77.1 | 76.1 | 77.4 | 76.4 | 75.2 |
| TYS (ksi) | L | 69.7 | 68.8 | 69.7 | 69.1 | 68.7 |
| K1c ksi sqrt (inch) | L-T | 29.2 | 29.3 | 28.8 | 29.4 | 32.7 |
| UTS (ksi) | LT[7] | 77.7 | 77.7 | 77.7 | 77.9 | 76.2 |
| TYS (ksi) | LT | 68.1 | 67.8 | 68 | 67.6 | 67.1 |
| K1c ksi sqrt (inch) | T-L | 23.4 | 23 | 23.2 | 23.6 | 25.5 |
| SCF[4] (unitless) | | 27 | 27.3 | 26.8 | 27.1 | 25.4 |

1 UTS = ultimate tensile strength
2 TYS = tensile yield strength
3 K1c = plane strain fracture toughness
4 SCF = stress corrosion factor
5 ST and S-L = short transverse direction
6 L and L-T = longitudinal direction
7 LT and T-L = long transverse direction

Inventive Examples 6–10

Inventive Example 6

A large commercially produced ingot was cast with an alloy composition listed in Table 3. The ingot was homogenized at 890° F. for 24 hours and air cooled to room temperature. The ingot was scalped to about 1" from each surface and then hot rolled to a 5" thickness plate at a temperature range of 830° F. to 700° F. The 5" plate was solution heat treated at 870–890° F. in an air furnace for about 2 to 4 hours then water quenched to room temperature.

After water quenching, the plate was artificially aged in two steps. The first artificial aging step was performed at 250° F. for 8 hours, while the second artificial aging step was performed at 320° F. for 24 hours. The heating rate of the temperature from the first artificial aging step to the second artificial aging step was about 25–30° F./hour. After the second artificial aging step, the plate was cooled to 200° F. from 320° F. at a cooling rate of about 25 to 30° F./hour.

The plate was tested for various mechanical properties such as ultimate tensile strength (UTS), tensile yield stress (TYS) and plane strain fracture toughness (K1c). The testing results from these mechanical properties are listed in Table 4. The stress corrosion factor (SCF) of the plate was also tested and the result is shown in Table 4.

Inventive Examples 7–10

The plates of Inventive Examples 7–10 were formed in the same manner as the plate of Inventive Example 6, except that the compositions of the plates were not the same. The compositions and testing results of the plates of Inventive Examples 7–10 are listed in Tables 3 and 4, respectively.

TABLE 3

| Composition | Inventive Example Plate No. 6 | 7 | 8 | 9 | 10 |
|---|---|---|---|---|---|
| Si (wt. %) | 0.04 | 0.02 | 0.02 | 0.02 | 0.04 |
| Fe (wt. %) | 0.07 | 0.07 | 0.07 | 0.07 | 0.07 |
| Cu (wt. %) | 2.15 | 2.14 | 2.14 | 2.14 | 2.17 |
| Mg (wt. %) | 1.95 | 1.90 | 1.90 | 1.90 | 1.93 |
| Zn (wt. %) | 6.42 | 6.32 | 6.32 | 6.32 | 6.42 |
| Zr (wt. %) | 0.11 | 0.11 | 0.11 | 0.11 | 0.11 |
| Cu + Mg (wt. %) | 4.10 | 4.04 | 0.04 | 0.04 | 4.10 |
| Cu + Mg + Zn (wt. %) | 10.52 | 10.36 | 10.36 | 10.36 | 10.52 |

TABLE 4

| Test | Test Direction | Inventive Example Plate Nos. 6 | 7 | 8 | 9 | 10 |
|---|---|---|---|---|---|---|
| UTS[1] (ksi) | ST[5] | 72.4 | 73.2 | 73.2 | 73.5 | 73.6 |
| TYS[2] (ksi) | ST | 63.7 | 63.0 | 63.3 | 63.3 | 62.8 |
| K1c[3] Ksi sqrt (inch) | S-L | 28.3 | 29.9 | 28.8 | 27.7 | 29.1 |
| UTS (ksi) | L[6] | 74.8 | 75.6 | 76.3 | 75.1 | 75.3 |
| TYS (ksi) | L | 68.4 | 69.0 | 68.9 | 69.3 | 69.8 |
| K1c Ksi sqrt (inch) | L-T | 34.2 | 35.4 | 34.7 | 34.3 | 32.8 |
| UTS (ksi) | LT[7] | 76.0 | 77.0 | 76.8 | 76.5 | 76.2 |
| TYS (ksi) | LT | 66.3 | 67.7 | 67.7 | 67.6 | 67.2 |
| K1c Ksi sqrt (inch) | T-L | 25.9 | 26.7 | 26.4 | 27.5 | 26.5 |
| SCF[4] (unitless) | | 25.4 | 25.9 | 26.1 | 26.2 | 26.3 |

1 UTS = ultimate tensile strength
2 TYS = tensile yield strength
3 K1c = plane strain fracture toughness
4 SCF = stress corrosion factor
5 ST and S-L = short transverse direction
6 L and L-T = longitudinal direction
7 LT and T-L = long transverse direction

Comparison of Inventive Plates 6–10 and Comparative Plates 1–5

Figure 2:
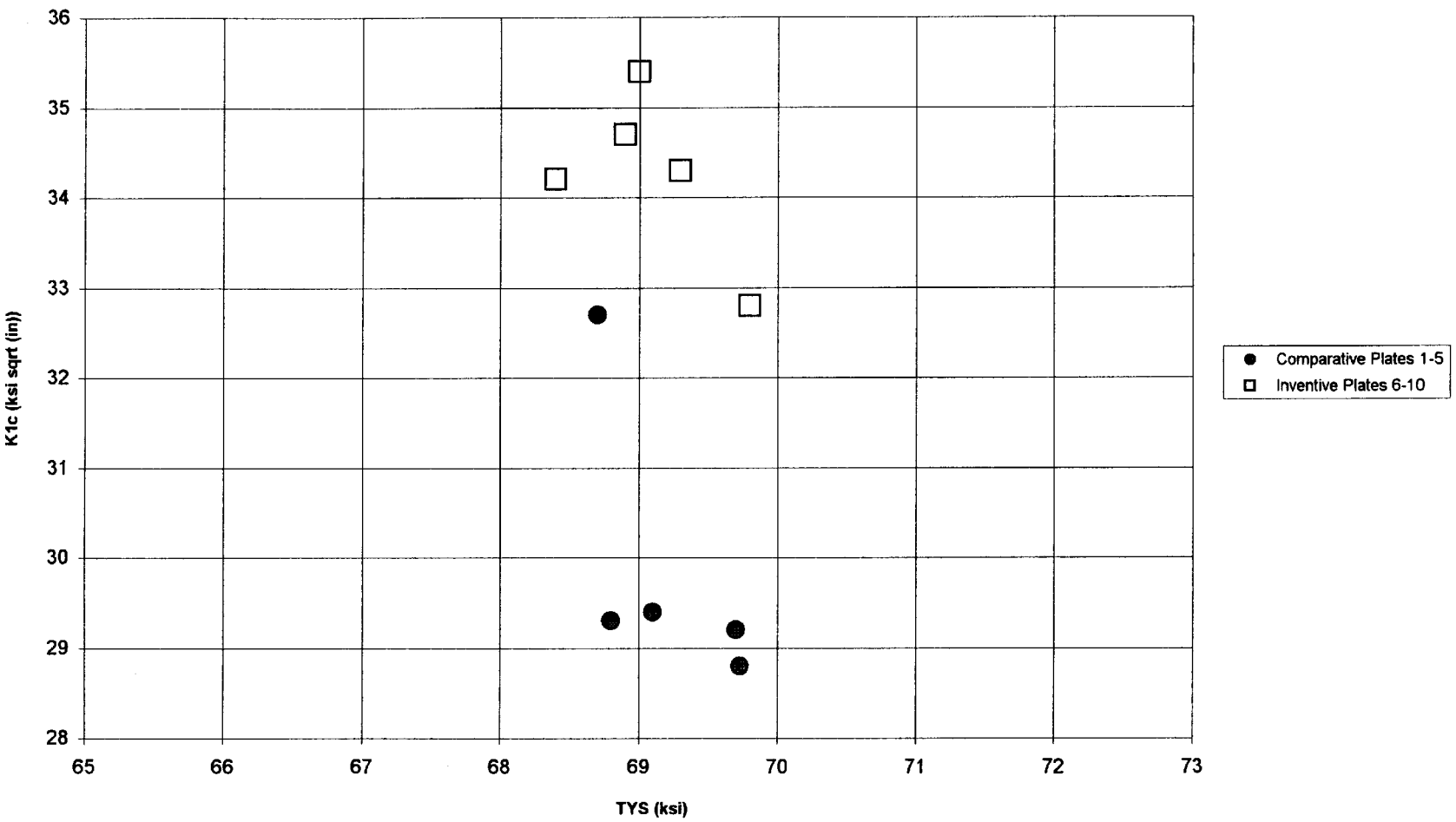
FIG. 2 is a graph depicting the plane strain fracture toughness and the tensile yield strength of a group of inventive plates and a group of comparative plates in the longitudinal direction.
Figure 3:
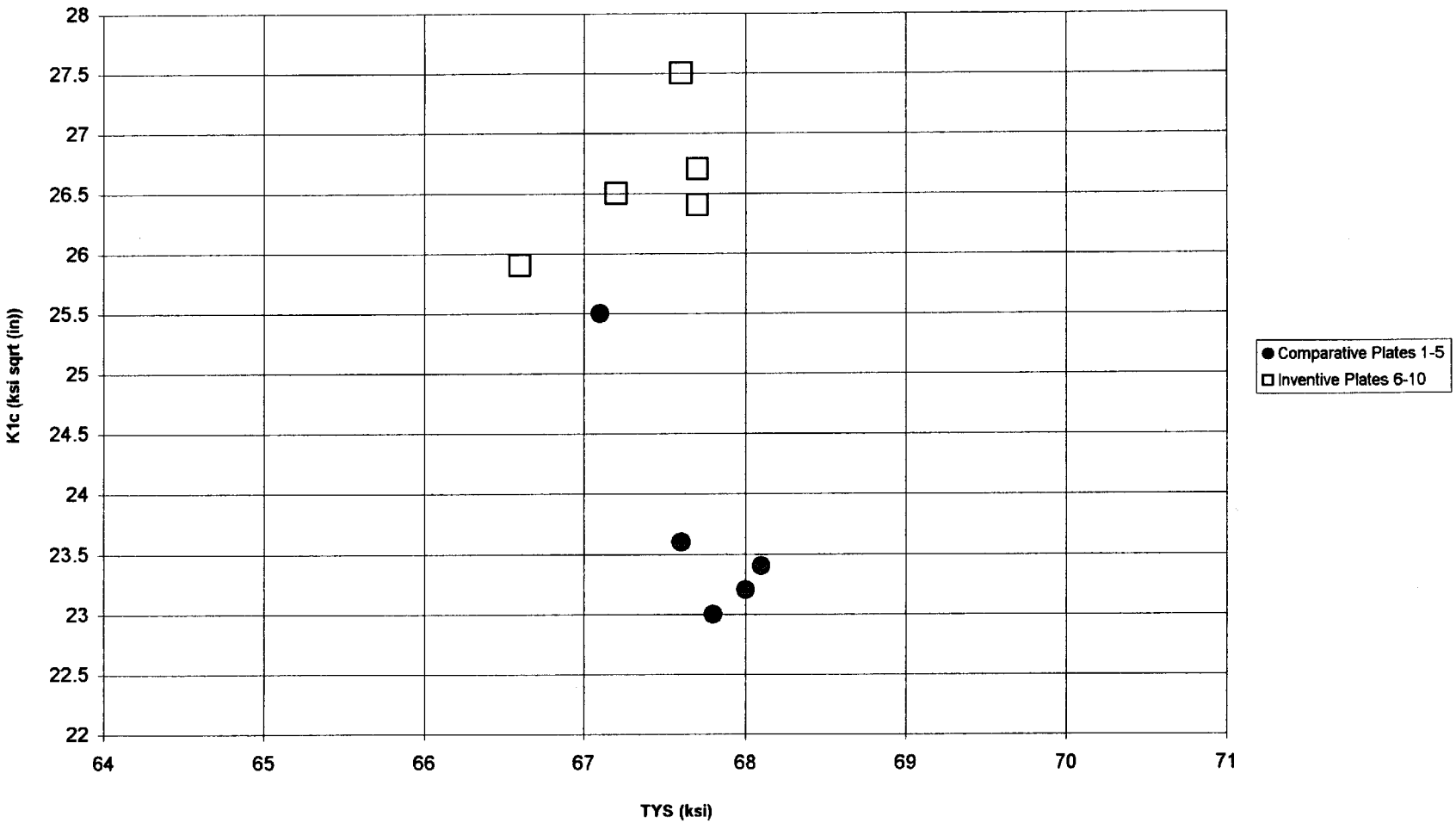
FIG. 3 is a graph depicting the plane strain fracture toughness and the tensile yield strength of a group of inventive plates and a group of comparative plates in the long transverse direction.

The information from Tables 2 and 4 was used in forming the graphs of FIGS. 1–4. As shown in FIGS. 1–3, the plane strain fracture toughnesses (K1c) of Inventive Plates 6–10 were unexpectedly much higher than the plane strain fracture toughnesses of Comparative Plates 1–5 in all measured directions at similar strength levels. The tensile yield strengths of Inventive Plates 6–10 were similar or slightly lower than the tensile yield strengths of Comparative Plates 1–5. The ultimate tensile strengths of Inventive Plates 6–10 were either similar or slightly lower than the ultimate tensile strengths of Comparative Plates 1–5.

Figure 4:
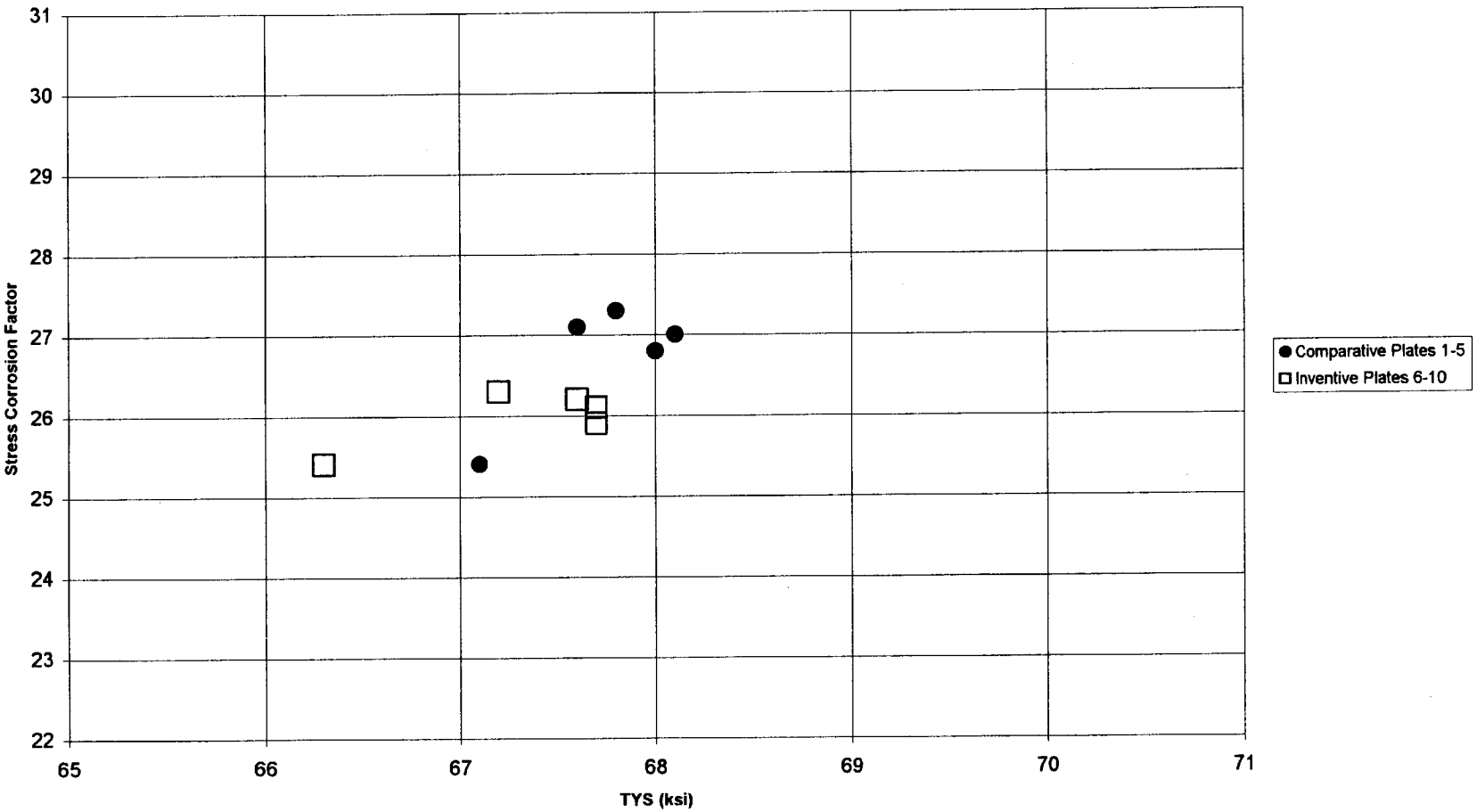
FIG. 4 is a graph depicting the stress corrosion factor and the tensile yield strength (in the long transverse direction) of a group of inventive plates and a group of comparative plates.

As shown in FIG. 4, the stress corrosion factors of Inventive Plates 6–10 were surprisingly lower than the stress corrosion factors of Comparative Plates 1–5. Having a lower stress corrosion factor correlates into a better corrosion resistance.

Comparative Examples 11–22

To better assist in showing the desirable properties of the aluminum alloys of the present invention, additional aluminum alloy properties were prepared with either desirable aluminum alloy compositions or processing conditions (including cooling rate), but not both as in Inventive Examples 6–10.

Comparative Examples 11–15 were prepared using desirable processing conditions, including a higher cooling rate, but not desirable compositions. Thus, Comparative Examples 11–15 used an inventive process and a typical aluminum alloy composition (7050). On the other hand, Comparative Examples 16–22 were prepared using desirable compositions, but not desirable processing conditions. Thus, Comparative Examples 16–22 used a conventional process (T7451) with an inventive aluminum alloy composition. The details of the compositions and processing conditions of Comparative Examples 11–22 are described below.

The compositions of Comparative Examples 11–15 are shown in Table 5, while the compositions of Comparative Examples 16–22 are shown in Table 6. Comparative Plates 16–22 had lower amounts of both copper and magnesium than Comparative Plates 11–15. Comparative Plates 11–15 had a copper and magnesium total wt. % combined over 4.20, and a total wt. % of zinc, copper and magnesium combined over 10.60.

Comparative Plates 11–15 were formed by the process steps described above in Inventive Example 6, including a cooling rate of 25–30° F./hour. Comparative Plates 16–22 were formed by the process steps described above in Comparative Example 1, including a cooling rate of 5–15° F./hour.

TABLE 5

| | Comparative Example Plate Nos. | | | | |
|---|---|---|---|---|---|
| Composition | 11 | 12 | 13 | 14 | 15 |
| Si (wt. %) | 0.03 | 0.04 | 0.04 | 0.04 | 0.03 |
| Fe (wt. %) | 0.06 | 0.06 | 0.08 | 0.08 | 0.06 |
| Cu (wt. %) | 2.24 | 2.22 | 2.21 | 2.21 | 2.24 |
| Mg (wt. %) | 2.04 | 2.02 | 2.00 | 2.01 | 2.04 |
| Zn (wt. %) | 6.46 | 6.52 | 6.44 | 6.44 | 6.46 |
| Zr (wt. %) | 0.11 | 0.12 | 0.10 | 0.10 | 0.11 |
| Cu + Mg (wt. %) | 4.28 | 4.24 | 4.21 | 4.22 | 4.28 |
| Cu + Mg + Zn (wt. %) | 10.74 | 10.76 | 10.65 | 10.66 | 10.74 |

TABLE 6

| | Comparative Example Plate Nos. | | | | | | |
|---|---|---|---|---|---|---|---|
| Composition | 16 | 17 | 18 | 19 | 20 | 21 | 22 |
| Si (wt. %) | 0.04 | 0.04 | 0.04 | 0.04 | 0.04 | 0.04 | 0.03 |
| Fe (wt. %) | 0.07 | 0.08 | 0.08 | 0.08 | 0.08 | 0.07 | 0.07 |
| Cu (wt. %) | 2.15 | 2.20 | 2.20 | 2.18 | 2.19 | 2.15 | 2.17 |
| Mg (wt. %) | 1.95 | 1.98 | 1.98 | 1.96 | 1.94 | 1.95 | 1.97 |
| Zn (wt. %) | 6.42 | 6.32 | 6.32 | 6.39 | 6.42 | 6.42 | 6.39 |
| Zr (wt. %) | 0.11 | 0.11 | 0.11 | 0.10 | 0.10 | 0.11 | 0.11 |
| Cu + Mg (wt. %) | 4.10 | 4.18 | 4.18 | 4.14 | 4.13 | 4.10 | 4.14 |
| Cu + Mg + Zn (wt. %) | 10.52 | 10.50 | 10.50 | 10.53 | 10.55 | 10.52 | 10.53 |

Discussion of Inventive Plates 6–10 and Comparative Plates 11–22

Comparative Plates 11–22 were tested for mechanical properties including tensile yield stress (TYS) and plane strain fracture toughness (K1c). The stress corrosion factors (SCF) of Comparative Plates 11–22 were also tested. The test results are shown in Tables 7 and 8.

TABLE 7

| | Test | Comparative Example Plate Nos. | | | | |
|---|---|---|---|---|---|---|
| Test | Direction | 6 | 7 | 8 | 9 | 10 |
| UTS[1] (ksi) | ST[5] | 73.9 | 73.2 | 72.0 | 74.0 | 74.0 |
| TYS[2] (ksi) | ST | 64.4 | 64.3 | 62.8 | 64.2 | 63.6 |
| K1c[3] Ksi sqrt (inch) | S-L | 25.2 | 26.0 | 26.3 | 26.6 | 25.9 |
| UTS (ksi) | L[6] | 76.2 | 76.4 | 75.6 | 75.2 | 76.7 |
| TYS (ksi) | L | 69.6 | 70.4 | 68.8 | 68.3 | 70.3 |
| K1c Ksi sqrt (inch) | L-T | 31.2 | 31.6 | 31.7 | 31.8 | 31.9 |
| UTS (ksi) | LT[7] | 77.6 | 77.9 | 76.8 | 76.5 | 77.8 |
| TYS (ksi) | LT | 68.2 | 68.7 | 67.4 | 67.4 | 68.7 |
| K1c Ksi sqrt (inch) | T-L | 24.1 | 25.1 | 25.0 | 25.5 | 23.6 |
| SCF[4] (unitless) | | 26.7 | 28.1 | 26.8 | 26.4 | 27.5 |

1 UTS = ultimate tensile strength
2 TYS = tensile yield strength
3 K1c = plane strain fracture toughness
4 SCF = stress corrosion factor
5 ST and S-L = short transverse direction
6 L and L-T = longitudinal direction
7 LT and T-L = long transverse direction

TABLE 8

| | Test | Comparative Example Plate Nos. | | | | | | |
|---|---|---|---|---|---|---|---|---|
| Test | Direction | 16 | 17 | 18 | 19 | 20 | 21 | 22 |
| UTS[1] (ksi) | ST[5] | 71.7 | 72.7 | 72.6 | 72.1 | 72.1 | 71.7 | 72.5 |
| TYS[2] (ksi) | ST | 60.9 | 62.2 | 62.4 | 61.2 | 61.4 | 61.5 | 62.0 |
| K1c[3] Ksi sqrt (inch) | S-L | 28.9 | 28.5 | 28.7 | 29.0 | 28.6 | 29.5 | 29.3 |
| UTS (ksi) | L[6] | 75.4 | 74.9 | 74.4 | 73.9 | 74.2 | 74.2 | 74.7 |
| TYS (ksi) | L | 68.4 | 67.3 | 67.4 | 67.4 | 66.8 | 66.8 | 67.9 |
| K1c Ksi sqrt (inch) | L-T | 33.8 | 32.9 | 33.7 | 33.2 | 33.3 | 37.1 | 32.2 |
| UTS (ksi) | LT[7] | 76.5 | 75.9 | 76.1 | 75.6 | 75.5 | 74.2 | 75.1 |
| TYS (ksi) | LT | 67.2 | 65.9 | 66.7 | 66.0 | 65.5 | 64.3 | 65.7 |
| K1c Ksi sqrt (inch) | T-L | 26.1 | 25.7 | 26.2 | 26.5 | 26.1 | 27.6 | 26.2 |
| SC[4] (unitless) | | 25.8 | 24.6 | 25.7 | 23.7 | 24.1 | 23.1 | 24.4 |

Figure 5:
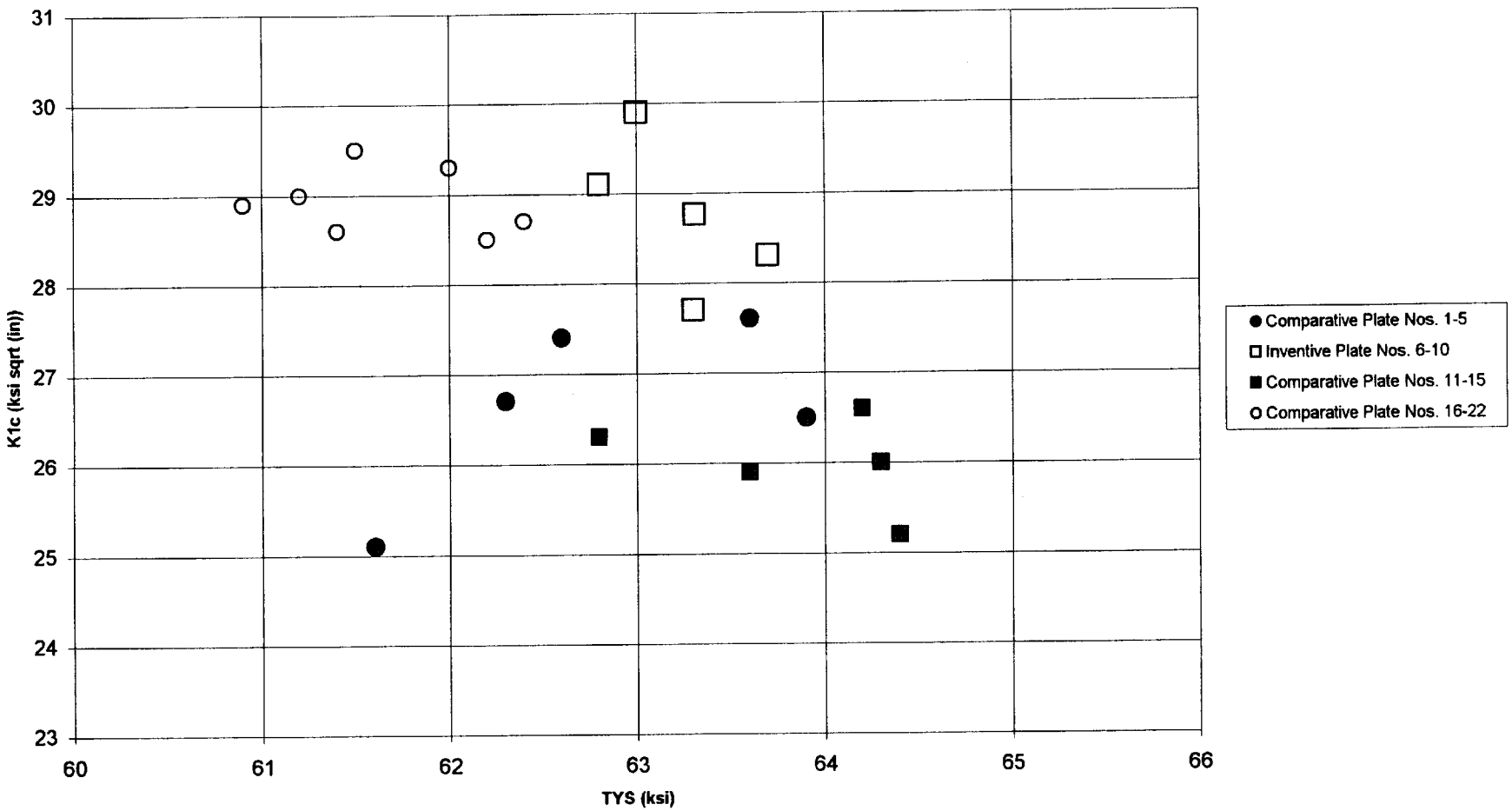
FIG. 5 is a graph depicting the plane strain fracture toughness and the tensile yield strength of a group of inventive plates and a group of comparative plates in the short transverse direction.
Figure 6:
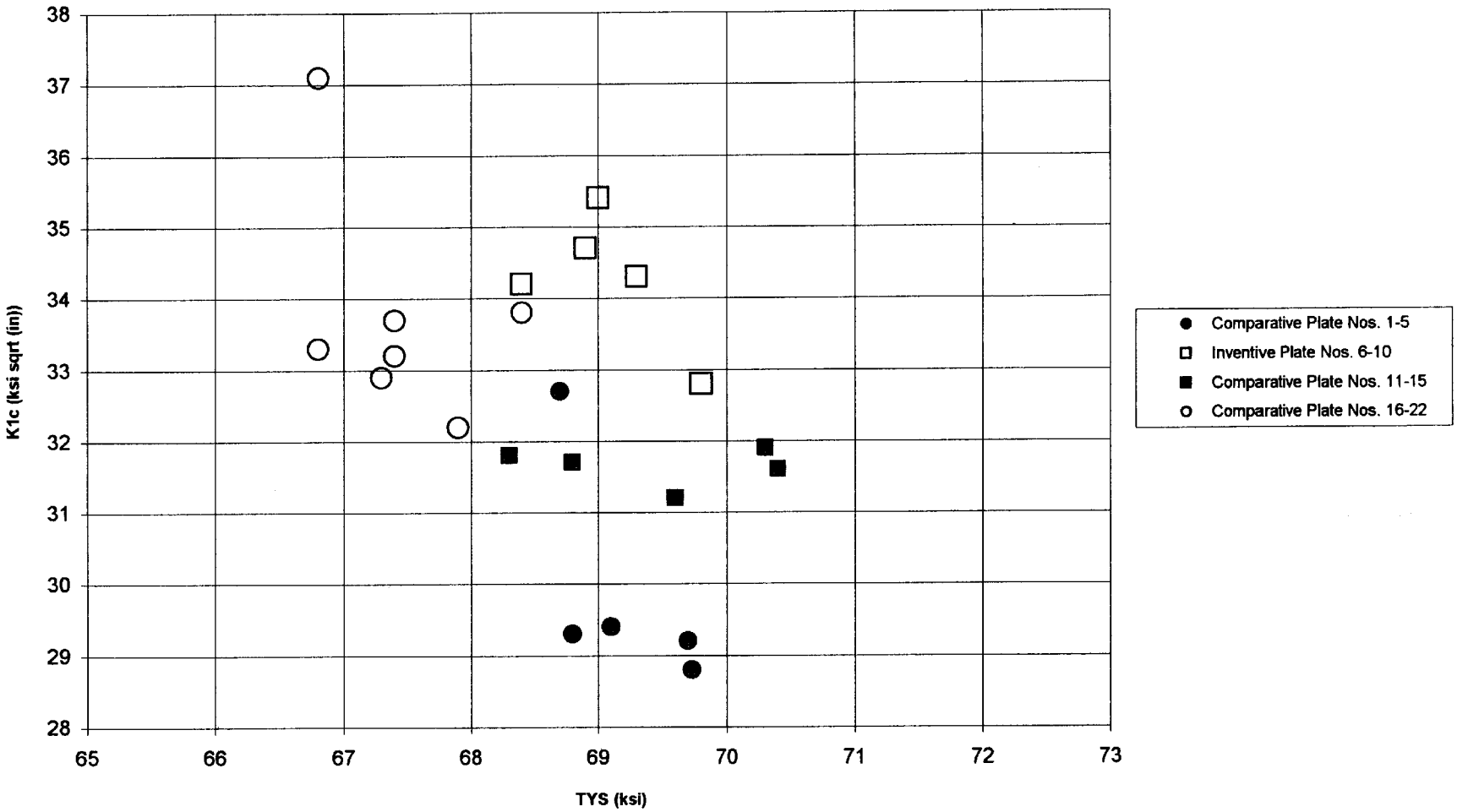
FIG. 6 is a graph depicting the plane strain fracture toughness and the tensile yield strength of a group of inventive plates and a group of comparative plates in the longitudinal direction.
Figure 7:
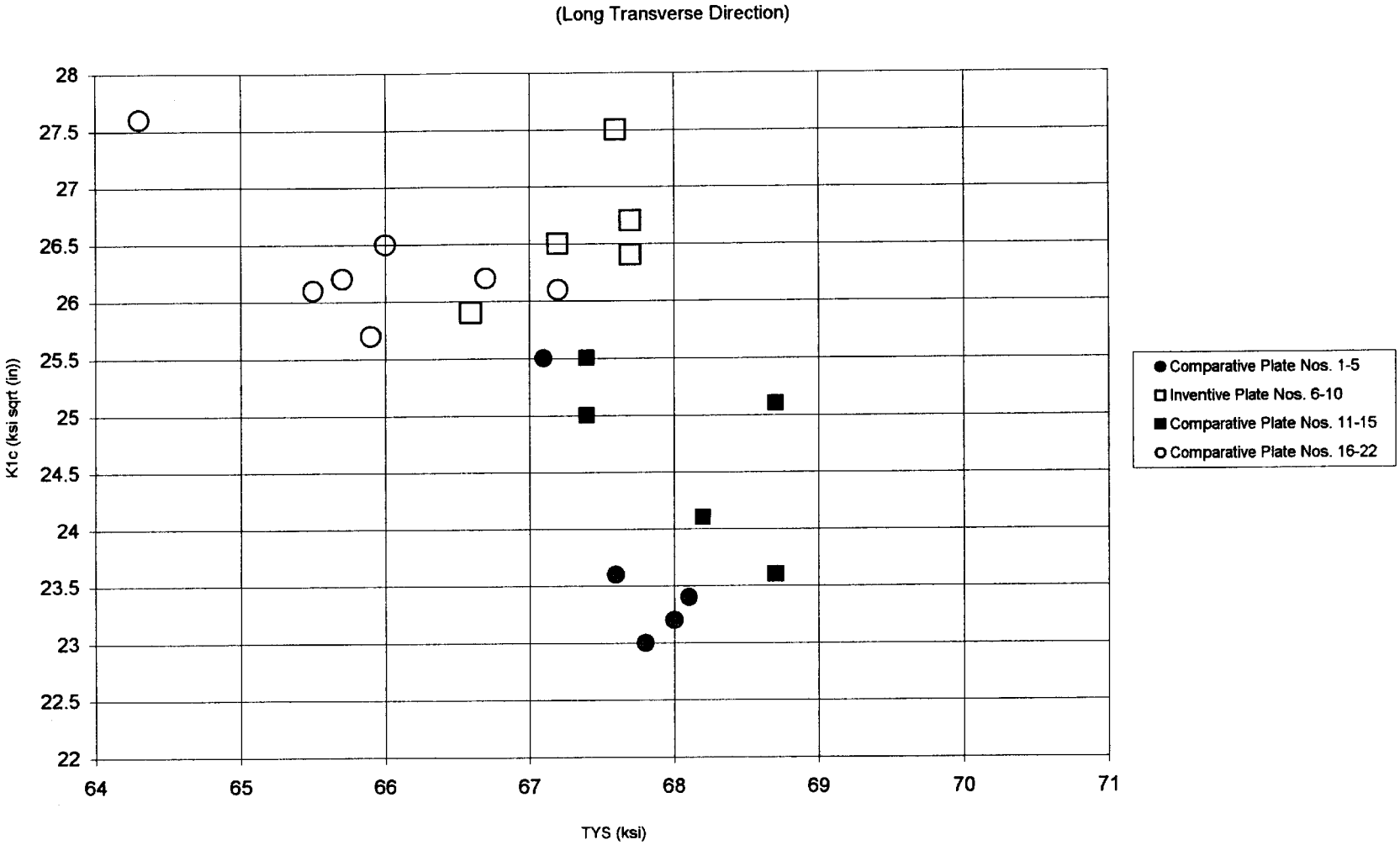
FIG. 7 is a graph depicting the plane strain fracture toughness and the tensile yield strength of a group of inventive plates and a group of comparative plates in the long transverse direction.

[1]UTS = ultimate tensile strength
[2]TYS = tensile yield strength
[3]Klc = plane strain fracture toughness
[4]SCF = stress corrosion factor
[5]ST and S-L = short transverse direction
[6]L and L-T = longitudinal direction
[7]LT and T-L = long transverse direction As shown in FIGS. 5–7, tensile yield stresses (TYS) and plane strain fracture toughnesses (K1c) were plotted from the test results of Tables 7 and 8. Inventive Plates 6–10 and Comparative Plates 1–5 and 11–22 were plotted in the short transverse direction (FIG. 5), the longitudinal direction (FIG. 6) and the long transverse direction (FIG. 7). Similarly, the stress corrosion factors of Inventive Plates 6–10 and Comparative Plates 1–5 and 11–22 were plotted in FIG. 8.

Inventive Plates 6–10 had good tensile yield strengths and plane strain fracture toughnesses using desirable aluminum alloy compositions and higher cooling rates. Using the inventive processing, Comparative Plates 11–15 had slightly higher tensile yield strengths, but had much lower plane strain fracture toughnesses. Using just desirable aluminum alloy compositions, Comparative Plates 16–22 had similar plane strain fracture toughnesses, but had lower tensile yield strengths. The tensile yield strengths and plane strain fracture toughnesses of Comparative Plates 11–22 were improved over the tensile yield strengths or plane strain fracture toughnesses of Comparative Plates 1–5.

Figure 8:
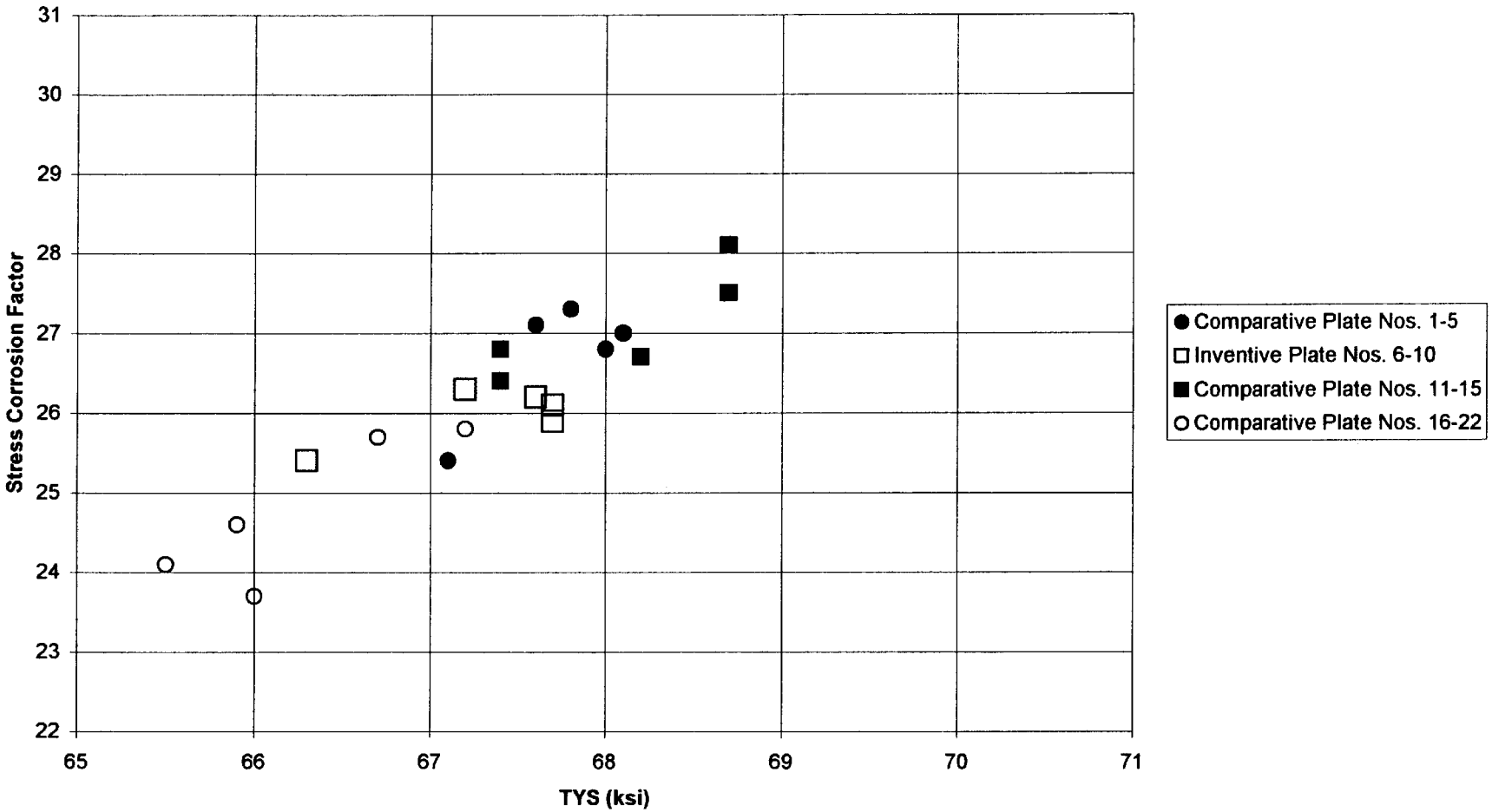
FIG. 8 is a graph depicting the stress corrosion factor and long transverse direction tensile yield strength of a group of inventive plates and comparative plates.

Inventive Plates 6–10 had a desirable stress corrosion factor and an improved stress corrosion factor over Comparative Plates 1–5 and 11–15 as shown in FIG. 8. Comparative Plates 16–22 had a lower stress corrosion factor, but with a lower tensile strength. As known in the art, maintaining a stress corrosion factor of less than 28 is indicative of good stress corrosion cracking (SCC) resistance for all practical purposes. Therefore, Inventive Examples 6–10, with improved tensile strength and fracture toughness, still maintains good SCC resistance.

Therefore, using desired aluminum alloy compositions and cooling rates, Inventive Plates 6–10 had a desirable combination of tensile yield strengths, plane strain fracture toughnesses and stress corrosion factors. This product is an improvement from traditional 7050–T7451 aluminum alloy plates.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A process for thermally treating an article made from an aluminum alloy, the process comprising:

providing the aluminum alloy consisting essentially of from about 5.7 to about 6.7 wt. % of zinc, less than 2.2 wt. % copper, less than 4.2 wt. % of the total weight percent of magnesium and copper combined, and less than 10.60 wt. % of the total weight percent of magnesium, copper and zinc combined, the balance being substantially aluminum, incidental elements and impurities;

solid solution heat treating the article;

quenching the article;

heating the article to a first temperature;

artificially aging the article at the first temperature;

heating the article to a second temperature, wherein the second temperature is higher than the first temperature;

artificially aging the article at the second temperature of from about 290 to about 360° F. for a duration of at least 6 hours; and cooling the article from the second temperature to 200° F. at a cooling rate of from about 20 to about 40° F./hour.

2. The process of claim 1, wherein the aluminum alloy comprises from about 1.9 to about 2.1 wt. % magnesium.

3. The process of claim 1, wherein the aluminum alloy comprises from about 2.0 to 2.2 wt. % of copper.

4. The process of claim 1, wherein the aluminum alloy further includes from about 0.08 to about 0.12 wt. % of zirconium.

5. The process of claim 1 further including performing cold work to the article.

6. The process of claim 1, wherein the heat up rate from the first temperature to the second temperature is from about 25 to about 40° F./hour.

7. The process of claim 1, wherein the cooling rate from the second temperature to 200° F. is from about 20 to about 30° F./hour.

8. The process of claim 7, wherein the cooling rate is from about 25 to about 30° F./hour.

9. The process of claim 1, wherein the first temperature is from about 220° F. to about 280° F. and artificially aging the article at the first temperature occurs for a duration of at least 30 minutes.

10. The process of claim 9, wherein the first temperature is from about 240 to about 260° F. and artificially aging the article at the first temperature occurs for a duration of from about 6 to about 10 hours.

11. The process of claim 1, wherein the second temperature is from about 310 to about 330° F. and artificially aging the article at the second temperature occurs for a duration of from about 18 to about 30 hours.

12. The process of claim 11, wherein the second temperature is from about 310 to about 330° F. and the artificially aging the article at the second temperature occurs for a duration of from about 22 to about 28 hours.

13. A process for artificially aging a solution heat treated aluminum alloy, the process comprising:

providing the aluminum alloy consisting essentially of from about 5.7 to about 6.7 wt. % of zinc, less than 2.2 wt. % copper, less than 4.2 wt. % of the total weight percent of magnesium and copper combined, and less than 10.60 wt. % of the total weight percent of magnesium, copper and zinc combined, the balance being substantially aluminum and incidental elements and impurities, artificially aging the article at a first temperature;

heating the article to a second temperature, wherein the second temperature is higher than the first temperature;

artificially aging the article at the second temperature of from about 290 to about 360° F. for a duration of at least 6 hours; and cooling the article from the second temperature to 200° F. at a cooling down rate of from about 20 to about 40° F./hour.

14. The process of claim 13, wherein the aluminum alloy comprises from about 2 to 2.2 wt. % copper.

15. The process of claim 13, wherein the aluminum alloy further includes from about 0.08 to about 0.12 wt. % of zirconium.

16. The process of claim 13, wherein the heat up rate from the first temperature to the second temperature is from about 25 to about 40° F./hour.

17. The process of claim 13, wherein the cooling rate from the second temperature to 200° F. is from about 20 to about 30° F./hour.

18. The process of claim 17, wherein the cooling rate is from about 25 to about 30° F./hour.

19. The process of claim 13, wherein the first temperature is from about 220° F. to about 280° F. and artificially aging the article at the first temperature occurs for a duration of at least 30 minutes.

20. The process of claim 19, wherein the first temperature is from about 240 to about 260° F. and artificially aging the article at the first temperature occurs for a duration of from about 6 to about 10 hours.

21. The process of claim 13, wherein the second temperature is from about 310 to about 330° F. and artificially aging the article at the second temperature occurs for a duration of from about 18 to about 30 hours.

22. The process of claim 21, wherein the second temperature is from about 310 to about 330° F. and the artificially aging the article at the second temperature occurs for a duration of from about 22 to about 28 hours.

23. A process for artificially aging a solution heat treated aluminum alloy, the process comprising:

providing the aluminum alloy consisting essentially of from about 5.7 to about 6.7 wt. % of zinc, less than 2.2 wt. % copper, less than 4.2 wt. % of the total weight percent of magnesium and copper combined, and less than 10.60 wt. % of the total weight percent of magnesium, copper and zinc combined, the balance being substantially aluminum and incidental elements and impurities, artificially aging the article at a first temperature;

heating the article to a second temperature, wherein the second temperature is higher than the first temperature, the heat up rate from the first temperature to the second temperature is from about 25 to about 40° F./hour.

artificially aging the article at the second temperature of from about 290 to about 360° F. for a duration of at least 6 hours; and cooling the article from the second temperature to 200° F. at a cooling down rate of from about 20 to about 40° F./hour.

24. The process of claim 23, wherein the aluminum alloy comprises from about 2 to 2.2 wt. % copper.

25. The process of claim 23, wherein the aluminum alloy further includes from about 0.08 to about 0.12 wt. % of zirconium.

26. The process of claim 23, wherein the heat up rate from the first temperature to the second temperature is from about 25 to about 30° F./hour.

27. The process of claim 26, wherein the cooling rate from the second temperature to 200° F. is from about 25 to about 30° F./hour.

28. The process of claim 23, wherein the first temperature is from about 220° F. to about 280° F. and artificially aging the article at the first temperature occurs for a duration of at least 30 minutes.

29. The process of claim 28, wherein the first temperature is from about 240 to about 260° F. and artificially aging the article at the first temperature occurs for a duration of from about 6 to about 10 hours.

30. The process of claim 23, wherein the second temperature is from about 310 to about 330° F. and artificially aging the article at the second temperature occurs for a duration of from about 18 to about 30 hours.

31. The process of claim 30 wherein the second temperature is from about 310 to about 330° F. and the artificially aging the article at the second temperature occurs for a duration of from about 22 to about 28 hours.

* * * * *